United States Patent [19]

Tachi et al.

[11] Patent Number: 4,605,168

[45] Date of Patent: Aug. 12, 1986

[54] ROTATING SPRAYING TYPE COATING APPARATUS WITH WASH SHROUD

[75] Inventors: Kazuyuki Tachi; Chikaaki Okuda; Shoichi Suzuki, all of Aichi, Japan

[73] Assignee: Kabushiki Kaisha Toyota Chuo Kenkyusho, Aichi, Japan

[21] Appl. No.: 805,570

[22] Filed: Dec. 5, 1985

[30] Foreign Application Priority Data

Dec. 13, 1984 [JP] Japan ..... 59-190365

[51] Int. Cl.[4] ..... B05B 3/10; B05B 15/02

[52] U.S. Cl. ..... 239/112; 239/223; 239/703

[58] Field of Search ..... 239/110, 112, 113, 120, 239/121, 223, 224, 700–703

[56] References Cited

U.S. PATENT DOCUMENTS

| | | | |
|---|---|---|---|
| 4,275,838 | 6/1981 | Fangmeyer | 239/112 X |
| 4,380,321 | 4/1983 | Culbertson et al. | 239/110 X |
| 4,422,576 | 12/1983 | Saito et al. | 239/703 X |

*Primary Examiner*—Andres Kashnikow

*Attorney, Agent, or Firm*—Mason, Fenwick & Lawrence

[57] ABSTRACT

A rotating spraying type coating apparatus with wash shroud comprises a rotary drive device, a spraying head connected to the rotary drive device, a paint feed passage connected to base end of the spraying head, a paint radiating part formed at top end of the spraying head, an air jet device of annular shape for jetting an air flow to direct paint particles forward which are radiated from the paint radiating part, a coating pattern adjusting valve for varying the flow rate of the air jetting from the air jet device, a wash shroud covering outside of the spraying head and movable forward and rearward, and an opening formed at front end of the wash shroud. The wash shroud is disposed during coating to the rearward position where the paint radiating part of the spraying head projects from the opening at the front end of the wash shroud and during washing to the forward position where the paint radiating part of the spraying head is arranged within the wash shroud, and the air jet device is installed around the opening at the front end of the wash shroud.

4 Claims, 5 Drawing Figures

ROTATING SPRAYING TYPE COATING APPARATUS WITH WASH SHROUD

BACKGROUND OF THE INVENTION

The present invention relates to a rotating spraying type coating apparatus with wash shroud.

Such a coating apparatus in the prior art comprises an air motor, a spraying head of bell-like shape serving also as a charging electrode and mounted on a rotary shaft of the air motor, a paint feed passage connected to base end of the spraying head, a paint radiating part formed at top end of the spraying head, an air jet device of annular shape installed at top end of a case of the air motor for jetting an air flow towards rear outside surface of the spraying head, a coating or spray pattern adjusting valve for varying flow rate of the air jetting from the air jet device, and a wash shroud covering outside of the spraying head and being movable forward and rearward for collecting a wash medium injected to the spraying head during washing. At the coating state, the wash shroud is disposed to the rearward position where the paint radiating part of the spraying head projects from an opening on the front end of the wash shroud; at the washing state, the wash shroud is disposed to the forward position where the paint radiating part of the spraying head is arranged within the wash shroud.

In this constitution, however, even if the flow rate of air jetting from the air jet device is largely varied, the coating pattern is not significantly varied and therefore the adjusting range of the coating pattern is narrow.

SUMMARY OF THE INVENTION

An object of the invention is to provide a rotating spraying type coating apparatus with wash shroud wherein above-mentioned disadvantages in the prior art are eliminated and adjusting range of the coating pattern is wide.

In order to attain the above object, the inventors have studied the cause of narrow adjusting range of the coating pattern in the prior art.

In a rotating spraying type coating apparatus in the prior art, distance from the opening of the air jet device to the paint radiating part at top end of the spraying head is as long as 40 mm or more. Moreover, since the air flow jetted from the opening of the air jet device impinges on rear outside surface of the spraying head of the bell-like shape, the axial speed of the air flow passing through outside position of the paint radiating part of the spraying head becomes very slow. Consequently, since the axial speed of the air flow is slow, the paint particles radiated at high speed in the radial direction from the paint radiating part of the spraying head by means of the centrifugal force cannot be accelerated well in the axial direction by the above-mentioned air flow and it is difficult to restrict the coating pattern to the small extent.

In order to restrict the coating pattern to the small extent, the distance from the opening of the air jet device to the paint radiating part of the spraying head must be decreased so as to raise the axial speed of the air flow passing through the outside position of the paint radiating part of the spraying head.

However, if the air jet device is arranged near the paint radiating part of the spraying head, the air jet device hinders the washing of the spraying head when the spraying head must be washed for the paint color changing or the like, thereby the spraying head cannot be washed well. Insufficient washing of the spraying head causes color mixing of the paint which may result in the serious coating defect.

Another object of the invention is to provide a rotating spraying type coating apparatus with wash shroud wherein adjusting range of the coating pattern can be widened without hindering the washing of the spraying head.

In the invention, in order to widen the adjusting range of the coating pattern without hindering the washing of the spraying head, the air jet device is installed around the opening at the front end of the wash shroud in a coating device of the prior art.

That is, a rotating spraying type coating apparatus with wash shroud according to the invention comprises a rotary drive device, a spraying head connected to the rotary drive device, a paint feed passage connected to base end of the spraying head, a paint radiating part formed at top end of the spraying head, an air jet device of annular shape for jetting an air flow to direct paint particles forward which are radiated from the paint radiating part, a coating pattern adjusting means for varying the flow rate of the air jetting from the air jet device, a wash shroud covering outside of the spraying head and being movable forward and rearward, and an opening formed at front end of the wash shroud, wherein the wash shroud is disposed during coating to the rearward position where the paint radiating part of the spraying head projects from the opening at the front end of the wash shroud and disposed during washing at the forward position where the paint radiating part of the spraying head is arranged within the wash shroud, and the air jet device is installed around the opening at the front end of the wash shroud.

In the rotating spraying type coating apparatus with wash shroud according to the invention, since the air jet device is installed around the opening at the front end of the wash shroud, the distance from the opening of the air jet device to the paint radiating part of the spraying head is decreased, the axial speed of the air flow passing through the outside position of the paint radiating part becomes rapid, and the coating pattern can be narrowed to the small extent. Accordingly, the adjusting range of the coating pattern is wide.

Moreover, at the washing state, since the air jet device is moved forward together with the wash shroud and disposed to front side of the spraying head, it does not hinder the washing of the spraying head.

DETAILED DESCRIPTION OF THE PREFERRED EMBODIMENTS

First Embodiment (refer to FIGS. 1 through 4)

Figure 1:
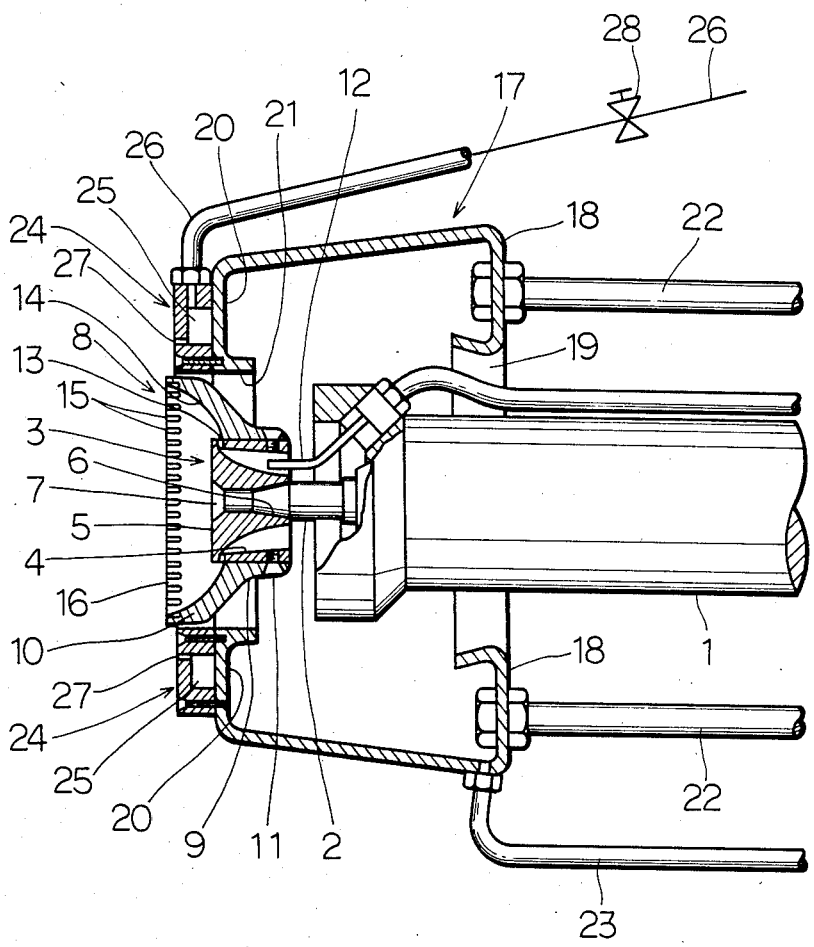
FIG. 1 is a side view partly in longitudinal section of a rotating spraying type coating apparatus with wash shroud as a first embodiment of the invention.

A rotating spraying type coating apparatus with wash shroud of a first embodiment shown in FIG. 1 comprises an air turbo motor 1, a rotary shaft 2 projecting from the case top end of the air turbo motor 1, a hub 3 fitted to the rotary shaft 2 and including a cylinder portion 4 and a disc portion 5 connected in concentric relation to the top end of the cylinder portion 4, and a mounting hole 6 of taper form bored on the center of the disc portion 5 of the hub 3. The top end of the taper form of the rotary shaft 2 of the air turbo motor 1 is fitted to the mounting hole 6, and the hub 3 is mounted in concentric relation to the rotary shaft 2 of the air turbo motor 1 by a screw 7 penetrating the center of the disc portion 5 of the hub 3. A bell-like body 8 composed of a cylinder portion 9 and a cup-like portion 10 connected in concentric relation to the top end of the cylinder portion 9 is fitted to the hub 3. The cylinder portion 9 of the bell-like body 8 is fitted to outer circumference of the cylinder portion 4 of the hub 3, and the cup-like portion 10 of the bell-like body 8 projects to front side of the hub 3. The bell-like body 8 is installed in concentric relation to the hub 3 by a screw 11 penetrating circumferential wall of the cylinder portion 9 of the bell-like body 8, and a spraying head is formed by the hub 3 and the bell-like body 8 in integral constitution. The spraying head 3, 8 is connected through the air turbo motor 1 to DC high voltage generating device (not shown), and serves also as a charging electrode.

A paint feed tube 12 connected to a paint supply device (not shown) is installed at the case top end of the air turbo motor 1, and an opening at top end of the paint feed tube 12 is disposed within the cylinder portion 4 of the hub 3 of the spraying head and the paint feed tube or passage 12 is connected to the hub 3 at base end side of the spraying head. A number of paint passing holes 13 leading to inside of the cup-like portion 10 of the bell-like body 8 are bored at regular intervals on circumferential wall at top end of the cylinder portion 4 of the hub 3, and inner circumferential surface of the cup-like portion 10 of the bell-like body 8 is made a paint flowing surface 14. A paint separating part 15 composed of a number of grooves at regular intervals along the axial direction is formed on top end of the paint flowing surface 14, and top end edge of the paint flowing surface 14, i.e., an opening edge at top end of the spraying head 3, 8 is made a paint radiating part 16.

Figure 2:
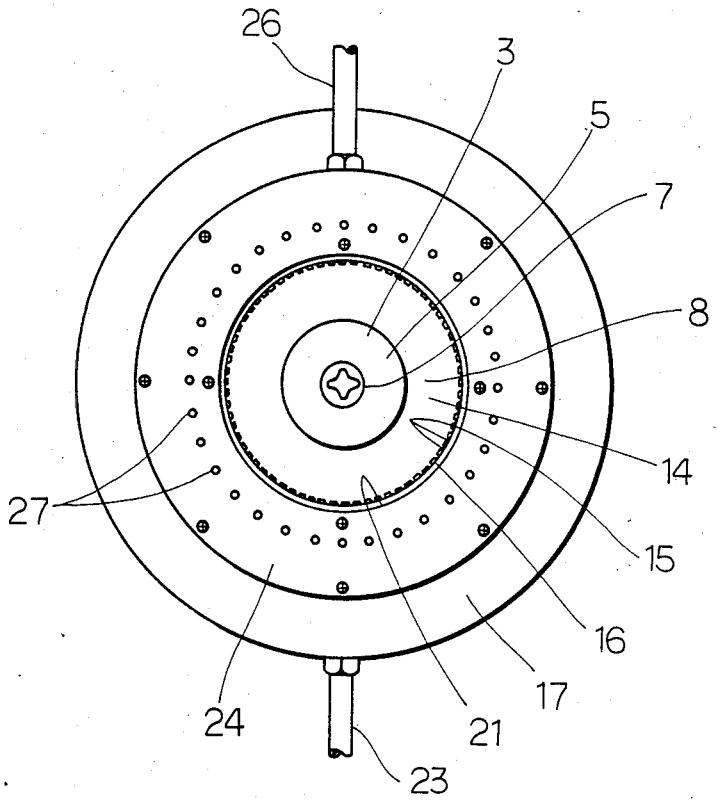
FIG. 2 is a front view of the coating apparatus of the first embodiment.

As shown in FIGS. 1 and 2, a wash shroud 17 of circular truncated cone is arranged outside of the spraying head 3, 8 and outside of the top end at the air turbo motor 1 and fitted in concentric relation to these members 1, 3, 8. The wash shroud 17 is made of insulation material, and top end of a drive shaft 22 made of insulation material of a reciprocation drive device (not shown) is connected to an end plate 18 in circular ring plate form at base end of the wash shroud 17. The wash shroud 17 is movable forward and rearward, and a wash medium suction passage 23 is connected to lower portion of circumferential wall at base end side of the wash shroud 17. An air jet device 24 is installed on front surface of an end plate 20 in circular ring plate form at top end of the wash shroud 17 and has an annular air passage 25 formed in concentric relation to the spraying head 3, 8. A high-pressure air feed passage 26 is connected to upper side of the air passage 25 through a flow control valve 28 for adjusting the coating pattern, and a number of air jet holes 27 are formed on front surface of the air passage 25 and spaced at regular intervals in annular shape in concentric relation to the spraying head 3, 8. Each air jet hole 27 is arranged in parallel to the axial direction of the spraying head 3, 8.

An opening 21 at front end of the wash shroud 17 formed by inner circumferential surface of the annular air jet device 24 and inner circumferential surface of the end plate 20 in circular ring plate form at top end of the wash shroud 17 has diameter slightly larger than the maximum outer diameter of the spraying head 3, 8, and the opening 19 at base end of the wash shroud 17 has further larger diameter.

When coating is performed by driving the coating apparatus of the embodiment, first, the reciprocation drive device (not shown) is driven rearward thereby the wash shroud 17 is moved rearward to the position where the paint radiating part 16 of the spraying head 3, 8 projects from the opening 21 at front end of the wash shroud 17 as shown in FIG. 1. Distance from opening surface of the air jet hole 27 of the air jet device 24 to opening surface of the paint radiating part 16 of the spraying head 3, 8 is 10 mm. Next, the spraying head 3, 8 is rotated at high speed, and DC high voltage is applied between the spraying head 3, 8 serving also as charging electrode and an article to be coated (not shown) disposed at front side of the spraying head 3, 8. High pressure air is supplied to the air passage 25 of the air jet device 24 and jetted forward from each air jet hole 27 in parallel to the axial direction of the spraying head 3, 8, and the paint is supplied from the paint feed passage 12 into the hub 3 of the spraying head.

The paint supplied to the hub 3 of the spraying head during rotating passes through a number of paint passing holes 13 by means of the centrifugal force and comes to inside of the cup-like portion 10 of the bell-like body 8 and further flows in the thin film state on the paint flowing surface 14 of the cup-like portion 10. The paint flows in a number of grooves of the paint separating part 15 and is separated into a number of filament-like streams to be radiated in the radial directions from the paint radiating part 16, thereby the atomization in filament-like mode is effected. The paint particles radiated from the paint radiating part 16 of the spraying head are flied in flying direction bent forward by means of the force of air flow jetted forward from the air jet hole 27 to the outside position of the paint radiating part 16 and also the electrostatic attractive force acting between the paint particles and the article to be coated, and then adhere to the article.

When the coating pattern is adjusted, the flow control valve 28 is adjusted thereby flow rate of air supplying to air passage 25, i.e., flow rate of air jetting from the air jet is varied.

Figure 4:
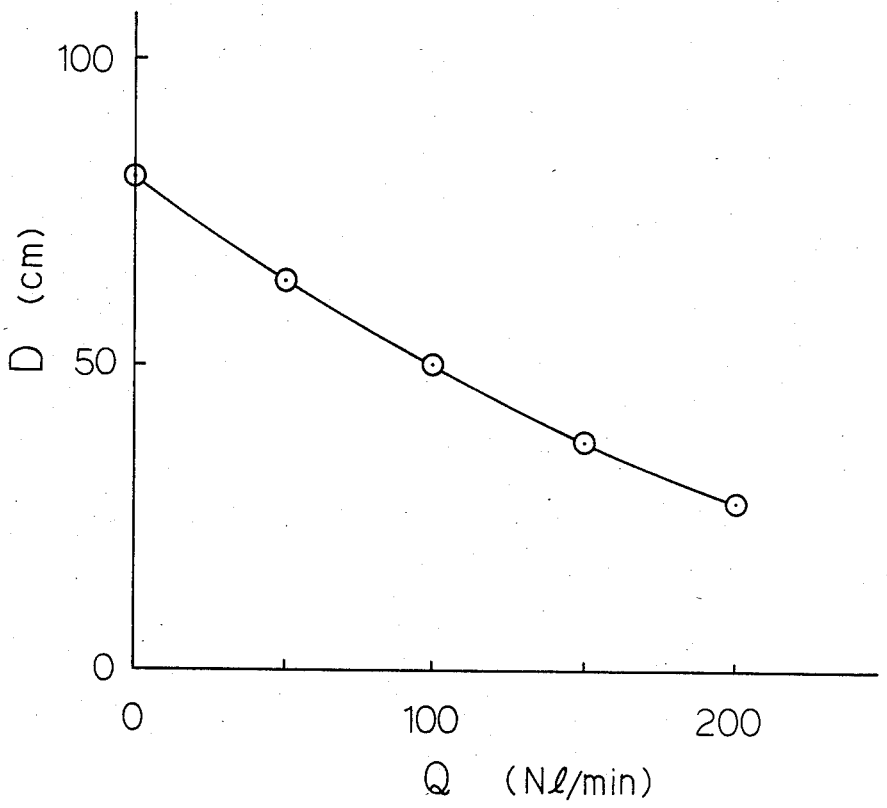
FIG. 4 is a diagram illustrating relation between coating pattern diameter D and air flow rate Q in the coating apparatus of the first embodiment.

FIG. 4 shows relation between the coating pattern diameter D and the air flow rate Q. The coating pattern diameter D becomes about 28 cm when the air flow rate Q is 200 Nl/min, and it is restricted to about 35% of that when the air flow rate is zero. On the contrary, it can be restricted to about 70~75% in the prior art.

The coating or transfer efficiency is about 95% or more. It is 60~80% in non-electrostatic type where electrostatic attractive force is not utilized. On the contrary, it is 20~30% in non-electrostatic type of the prior art.

In the coating apparatus of the embodiment, since the distance from the opening surface of the air jet hole 27 to the opening surface of the paint radiating part 16 of the spraying head 3, 8 is as short as 10 mm and there is no obstacle on which the air flow impinges at front side of the air jet hole 27, the axial speed of the air flow passing through the outside position of the paint radiating part 16 is very rapid. Consequently, the paint particles radiated from the paint radiating part 16 can be accelerated well in the axial direction and the coating pattern can be restricted to the small extent.

If the opening surface of air jet hole 27 is disposed further close to the opening surface of the paint radiating part 16, the coating pattern can be further restricted to the small extent. However, since the paint particles are apt to adhere to the outer circumferential surface of the spraying head 3, 8, or the top end of the air jet device 24 and the wash shroud 17 in this case, the distance from the opening surface of the air jet hole 27 to the opening surface of the paint radiating part 16 is preferably 1~30 mm, particularly 5~15 mm.

Figure 3:
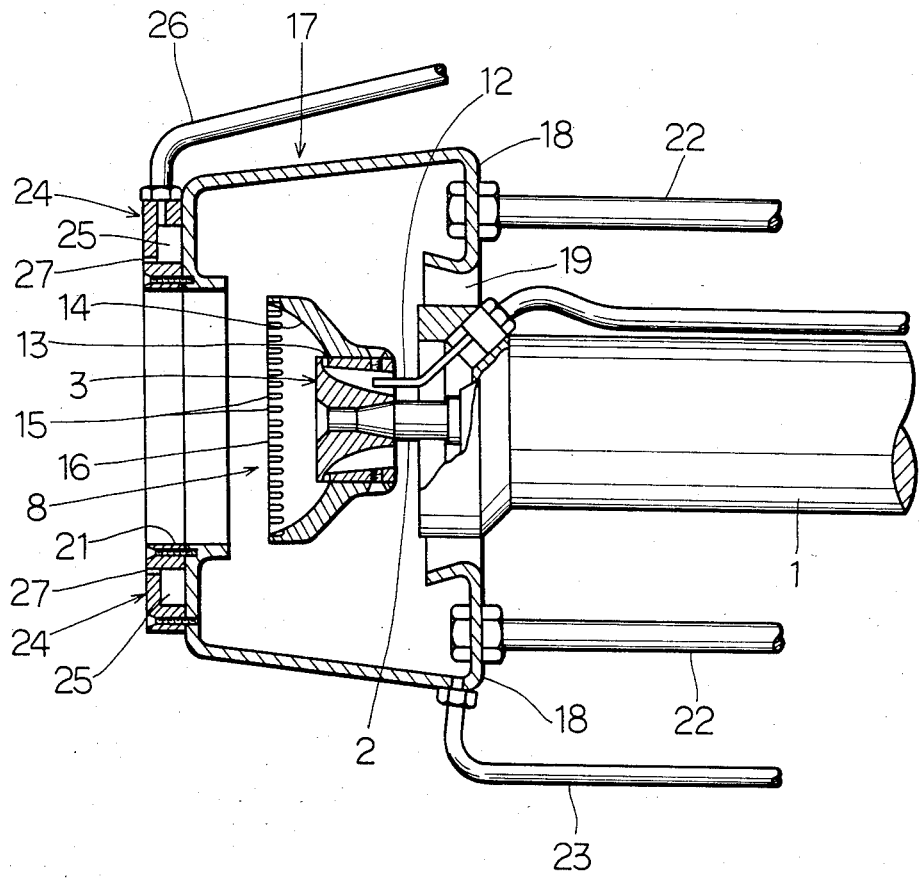
FIG. 3 is a side view partly in longitudinal section of the coating apparatus of the first embodiment illustrating the washing state.

When washing is performed by driving the coating apparatus of the embodiment, the reciprocation drive device (not shown) is driven forward thereby the wash shroud 17 is moved forward to the position where the spraying head 3, 8 is arranged within the wash shroud 17 as shown in FIG. 3, and then thinner or air, i.e., the wash medium is injected through the paint feed passage 12 to inside of the hub 3 of the spraying head during rotating without application of the DC high voltage.

The wash medium injected to the hub 3 of the spraying head during rotating passes through the paint passing holes 13, the paint flowing surface 14 and the paint separating part 15 and then is radiated from the paint radiating part 16 by means of the centrifugal force in similar manner to the paint at the coating state, so as to wash the inner surface of the spraying head 3, 8 during the process. The wash medium radiated from the paint radiating part 16 impinges on the inner circumferential surface of the wash shroud 17 and is collected to lower portion at base end side of the wash shroud 17 and exhausted through the wash medium suction passage 23.

In the coating apparatus of the embodiment, since the air jet device 24 is installed around the opening 21 at the front end of the wash shroud 17, at the washing state, the wash shroud 17 is moved forward thereby the air jet device 24 is disposed at front side of the spraying head 3, 8 as shown in FIG. 3. Consequently, the air jet device 24 does not hinder the washing of the spraying head 3, 8.

Figure 5:
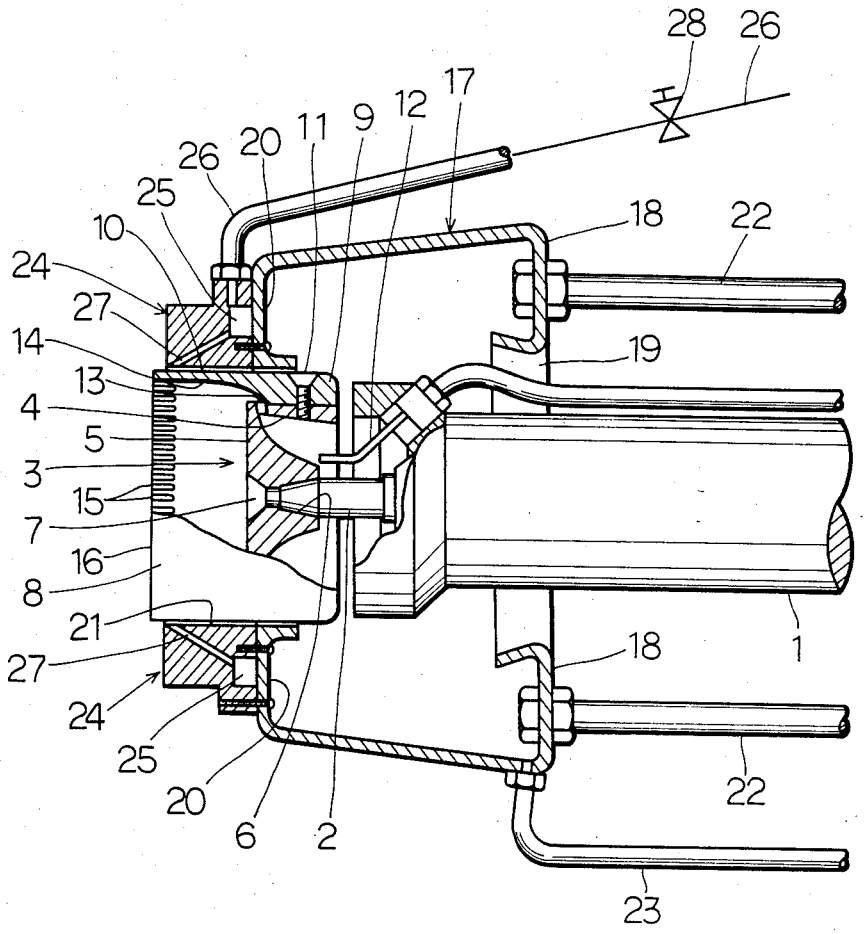
FIG. 5 is a side view partly in longitudinal section of a rotating spraying type coating apparatus with wash shroud as a second embodiment of the invention.

Second Embodiment (refer to FIG. 5)

In a rotating spraying type coating apparatus with wash shroud of a second embodiment shown in FIG. 5, in comparison to the first embodiment, the bell-like body in the first embodiment is replaced by a cylinder 8 with a rear half cylinder portion 9 and a front half cylinder portion 10 connected in concentric relation so as to constitute a spraying head 3, 8, and an air jet device 24 is provided with air jet holes 27 each arranged at angle of 30° with respect to the axial direction of the spraying head 3, 8 and directed inward towards the center. The second embodiment is similar to the first embodiment except for the abovementioned difference, and like parts in FIG. 5 are designated by the same reference numerals and the description shall be omitted.

In the coating apparatus of the embodiment, since the air jet hole 27 is inclined from the axial direction, the axial speed of the air flow becomes slightly slow. However, since the air jet hole 27 is bored towards the center, the paint is not apt to adhere to the spraying head 3, 8, the air jet device 24 or the wash shroud 17 even if the opening of the air jet hole 27 is brought sufficiently close to the paint radiating part 16 of the spraying head. Accordingly, when the opening of the air jet hole 27 is brought sufficiently close to the paint radiating part 16, similar effect to the first embodiment can be obtained.

The angle of the air jet hole 27 with respect to the axial direction is preferably 45° or less.

What we claim is:

1. A rotating spraying type coating apparatus with wash shroud, comprising:

a rotary drive device;

a spraying head connected to the rotary drive device;

a paint feed passage connected to base end of the spraying head;

a paint radiating part formed at top end of the spraying head;

an air jet device of annular shape for jetting an air flow to direct paint particles forward which are radiated from the paint radiating part;

a coating pattern adjusting means for varying the flow rate of the air jetting from the air jet device;

a wash shroud covering outside of the spraying head and being movable forward and rearward; and an opening formed at front end of the wash shroud, whereby said wash shroud is disposed during coating to the rearward position where the paint radiating part of the spraying head projects from the opening at the front end of the wash shroud and during washing to the forward position where the paint radiating part of the spraying head is arranged within the wash shroud, wherein said air jet device is installed around the opening at the front end of the wash shroud.

2. A coating apparatus as set forth in claim 1, wherein said air jet device has an air jet hole means for jetting the air jet in parallel to the axial direction of the spraying head.

3. A coating apparatus as set forth in claim 1, wherein said air jet device has an air jet hole means for jetting the air flow in a direction inclined with respect to the axial direction of the spraying head towards the center.

4. A coating apparatus as set forth in claim 3, wherein the inclination angle of the air flow jetting from the air jet means with respect to the axial direction of the spraying head is not more than 45°.

* * * * *